United States Patent [19]

Mazzotti

[11] 4,272,025

[45] Jun. 9, 1981

[54] WATER DISTRIBUTION SYSTEM FOR AN ICE MAKING DEVICE

[76] Inventor: Ermanno Mazzotti, 501 Newberry Dr., Streamwood, Ill. 60103

[21] Appl. No.: 40,851

[22] Filed: May 21, 1979

[51] Int. Cl.[3] ..... B05B 3/16

[52] U.S. Cl. ..... 239/240; 239/538; 239/DIG. 1

[58] Field of Search ..... 239/7, 11, 103, 115, 239/116, 97, 222, 222.11, 222.13, 225, 231, 240, 380, 381, 499, 504, 513, 520, 538, 563, 597, DIG. 1

[56] References Cited

U.S. PATENT DOCUMENTS

| | | | |
|---|---|---|---|
| 1,218,936 | 3/1917 | Ford | 239/240 X |
| 3,353,752 | 11/1967 | Ranhagen et al. | 239/538 |
| 3,880,357 | 4/1975 | Baisch | 239/225 X |

FOREIGN PATENT DOCUMENTS

| | | | |
|---|---|---|---|
| 1109997 | 6/1961 | Fed. Rep. of Germany | 239/538 |

*Primary Examiner*—Andres Kashnikow

*Attorney, Agent, or Firm*—Lockwood, Dewey, Alex & Cummings

[57] ABSTRACT

A water distribution system for spraying a plurality of fine streams of water in a relatively uniform manner onto an ice forming surface. A hollow spraying tube is rotationally and coaxially disposed in a shielding tube of larger diameter. The shielding tube has an elongate slot extending substantially the axial length of the spraying tube such that streams of water are sprayed through those orifices in the spraying tube not shielded by the shielding tube and through the elongate slot. The width of the slot determines the angular arc of spray from the system. The shielding tube is adjustably secured to one side of a turbine housing to adjust the spray direction. A turbine blade assembly is rotationally disposed within the turbine housing and is operatively connected to the spraying tube. Pressurized fluid through an inlet of the turbine housing rotationally drives the blade assembly and the spraying tube and the water is discharged in an unpressurized condition through an outlet of the turbine housing. One end of the spraying tube is open for communication with a source of fluid to be sprayed.

7 Claims, 10 Drawing Figures

WATER DISTRIBUTION SYSTEM FOR AN ICE MAKING DEVICE

BACKGROUND AND DESCRIPTION OF THE INVENTION

This invention relates in general to a water distribution system for spraying of water onto an ice forming surface of an ice making machine, and is more particularly concerned with such water distribution apparatus which provides a fine and uniform spray of water onto the ice forming surface from a plurality of orifices defined in a cylindrical spraying means, the spraying means being substantially shielded except for at least one opening in the shielding means through which the fine water streams are sprayed, the spraying means being rotatable in the shielding means, as by a turbine blade assembly in a hydraulically driven turbine.

Various types of ice cube making machines for forming crystal clear ice cubes are known to the prior art. Such crystal clear ice cubes are usually more appealing to consumers than the cloudy appearing cubes, such as those cubes obtained from freezing water in ice cube trays. The cloudy appearance of conventional cubes formed by freezing water in trays results from entrapped dissolved gases coming out of solution from the water during freezing and from impurities trapped in the freezing water. Crystal clear ice cube forming machines have heretofore enjoyed considerable popularity in many commercial establishments, such as, for example, in hotels, restaurants or the like. More recently, a significant and growing market for smaller versions of these commercial ice cube making machines has come into being with these smaller "residential" machines compatible for use in offices and the like as well as in homes.

It is known in the prior art ice cube making machines to have an inverted ice cube forming tray with a plurality of individual ice cube forming cups thermally connected to an evaporator coil of the refrigeration system. The ice cube forming cups are usually metallic for good heat transfer to the evaporator coils. Cold water of about 32° F. is continually sprayed into the ice cube forming cups, as by a nozzle disposed below each cup. Since the cups are maintained at a temperature below the freezing point of water by the evaporator coils, ice is continually formed in the ice cube forming cups until a complete cube is formed in each of the cups. At this time, the cups are warmed to a temperature above the freezing point of water, as by passing warmer tap water about the top side of the ice cube forming cups such that the outer surface of each cube in contact with its cup melts and the cubes thereupon fall from the inverted cups.

In spraying of water into the ice cube forming cups during formation of the ice cubes, it has been common practice to employ a plurality of fixedly mounted nozzles disposed below the ice cube forming cups, as on a water supply line, to continuously spray water onto and into the cups. Since it has not heretofore been thought economical to provide a separate nozzle for each of the cups, it is also known to design the nozzle to provide a single, broad stream of water to a plurality of cups. For example, five spraying nozzles may accommodate fifteen ice cube forming cups by each of the nozzles having a thin and elongated orifice such that a single stream of water from each nozzle simultaneously sprays three adjacent ice cube forming cups. While such an arrangement is more economical from a manufacturing standpoint, it has operational shortcomings. The continuous and substantial volume of water from such an orifice has a substantial melting effect upon layers of ice already formed in the ice cube forming cups. This substantial stream of water is further not easily or effectively broken down or atomized into tiny water droplets. Tiny droplets promote faster and more efficient formation of ice in the ice cube forming cups than from a continuous stream of water since heat is readily transferred from the tiny droplets of cold water to form ice before the water droplet has had a chance to flow away from the ice forming areas.

Some attempts have been made to mount directional spraying nozzles on a reciprocating spraying arm with the arm reciprocatingly moved through an angular arc to spray water in fine droplets onto an ice cube forming surface. These attempts have not met with commercial success since electric motors are prone to fail in the high humidity conditions encountered in the ice making machine. Furthermore, this type of arrangement is not operationally efficient since only a smaller portion of the ice cube forming surface is being sprayed at any given moment. Of course, it is also dangerous to use any electrical equipment, such as a motor, in the high humidity spraying area of the ice cube machine because of possible electrical shock hazards which may result to the machine users.

The prior art nozzle sprayers are also prone to partial or complete orifice blockage due to buildups of sediments and minerals. Of course, during total orifice blockage no ice cubes are formed in the cups associated with the blocked nozzles. Malformed ice cubes result from partial orifice blockage. Partial nozzle blockage, therefore, results in reduced ice cube production. The cost of maintenance and repair to periodically correct such problems is, of course, substantial, especially in view of the initial cost of a residential type ice cube making machine.

It is, therefore, a primary object of the present invention to provide a fine spray directed within a predetermined angular arc onto an ice cube forming surface wherein the entire ice cube forming surface is continuously sprayed by fine water streams from many orifices for each ice cube forming cup.

A related object of the present invention is to provide a spraying unit for spraying fluid in a predetermined direction from the spraying unit onto a surface in spaced relation from the spraying unit wherein the spraying unit includes a rotatable spraying tube with a plurality of orifices extending into a hollow interior of the spraying tube and shielding means disposed about the rotatable spraying tube with at least one opening defined through the shielding means through which fluid may be sprayed through those orifices which are not shielded by the shielding means, and means for rotating the spraying tube such that the fine streams of fluid from the orifices continuously move or sweep across the surface being sprayed.

A further object of the present invention is to provide spraying apparatus for an ice cube making machine which provides a self-cleaning action for keeping the orifices free of partial or complete blockage from sediment or mineral deposits.

Yet another object of the present invention is to provide such spraying apparatus wherein the rotatable spraying means is driven by a turbine also operated from fluid or water pressure and having a high degree of reliability, few moving parts and economy of manufacture.

A further object of the present invention is to provide spraying apparatus for dispersing the sprayed water into a finer and moving spray which operates from lower input water pressures such that the time to form crystal clear ice cubes in an ice making machine is substantially reduced and the attendant operating efficiency and ice cube making capability of the machine are substantially enhanced.

These advantages of the invention, and others, including those inherent in the invention, are provided by spraying apparatus for continuously spraying fine streams of fluid within a predetermined angular arc from the spraying apparatus onto a surface in spaced relation from the spraying apparatus. The spraying apparatus includes rotatable spraying means with a plurality of orifices extending into a hollow interior of the spraying means, the hollow interior of the spraying means communicating with a supply of fluid to be sprayed, shielding means disposed about the rotatable spraying means with sufficient operational clearance between the spraying means and the shielding means to permit said spraying means to be rotated within said shielding means, the shielding means having at least one open area defined therein through which fluid may be sprayed through those orifices of the spraying means at the open areas which are not shielded by the shielding means, and means for rotating the spraying means such that fluid is sprayed from the spraying means through the open area in the shielding means in a plurality of fine streams which continually sweep across the surface being sprayed. The rotatable spraying means preferably comprises an elongate and hollow cylindrical tube with a plurality of apertures defined therethrough. The cylindrical tube is closed at one end and opened at an opposite end for communication with a pressurized supply of fluid. The shielding means preferably comprises another hollow tube of slightly larger inside diameter than the outside diameter of the spraying tube, the shielding tube having at least one cut out or open area defined therethrough such that fluid may be sprayed through those orifices of the spraying tube which are not shielded by the shielding tube. The shielding tube is also closed at the same end as the spraying tube and has an opposite end suitable for adjusting the angular position of the cut out or open area to adjust the direction of spray.

The means for rotating the spraying means preferably comprises a turbine also driven by fluid pressure. The turbine includes a housing with a water inlet and a water outlet and in which a turbine blade assembly is rotatably disposed. The turbine blade assembly is operatively connected to the spraying means to rotatably drive the same. An aperture is defined in the turbine housing through which the spraying tube extends to the turbine blade assembly. An end cover or the like encloses an opposite side of the turbine housing. The end cover has an aperture defined therethrough for communication of a source of fluid pressure with the hollow interior of the spraying tube and further provides a bearing for the open end of the spraying tube. Pressurized water at the turbine housing water inlet causes rotation of the turbine blade assembly, and hence the spraying tube, and the water is thereafter expelled through the water outlet of the turbine housing in a substantially unpressurized condition.

Features of the present invention which are believed to be novel and patentable are set forth with particularity in the appended claims. The invention together with the further advantages thereof can best be understood by reference to the following description taken in conjunction with the accompanying drawings and the several figures in which like reference numerals identify like elements, and in which:

Figure 1:
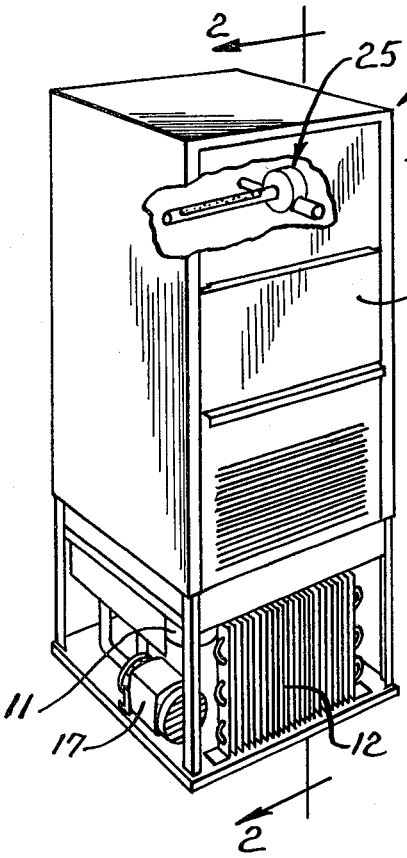
FIG. 1 is a perspective view with portions of the exterior cabinet removed to show certain interior components of an ice making machine and with the ice making machine party broken away to show the spraying apparatus of the present invention in such an ice making machine.
Figure 2:
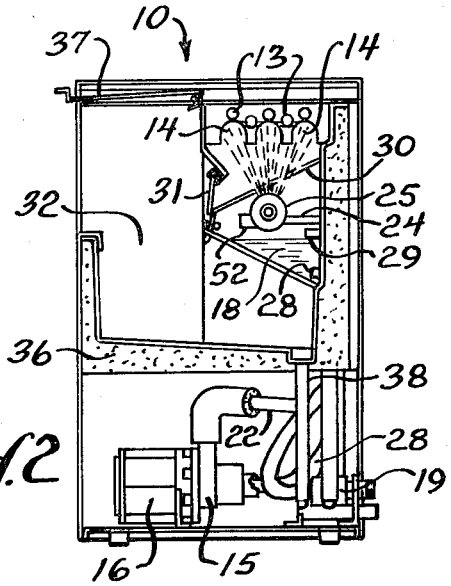
FIG. 2 is a sectional view taken in elevation substantially along sectional line 2—2 in FIG. 1 further illustrating the interior construction of an exemplary ice making machine with the spraying apparatus of the present invention disposed therein.
Figure 3:
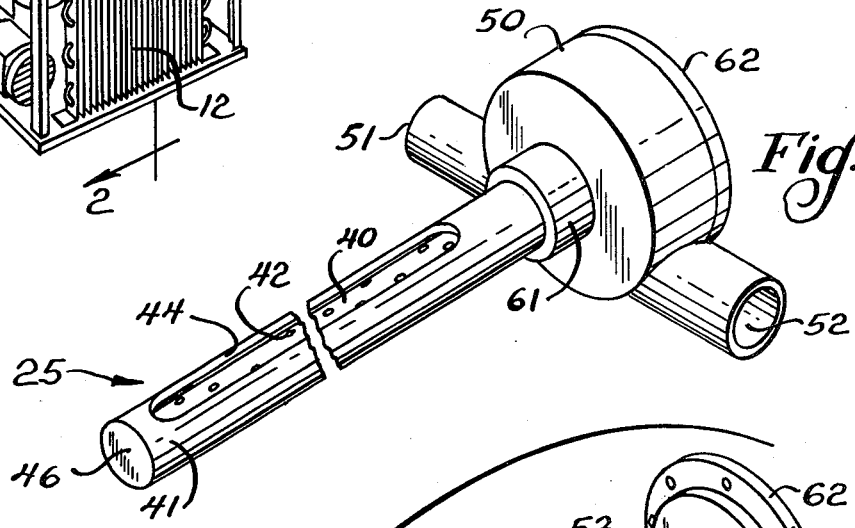
FIG. 3 is an enlarged perspective view of the spraying apparatus of the present invention illustrating the shielding tube with an elongate cut out or slot from which fluid is sprayed from those orifices of the spraying tube which are not shielded.
Figure 4:
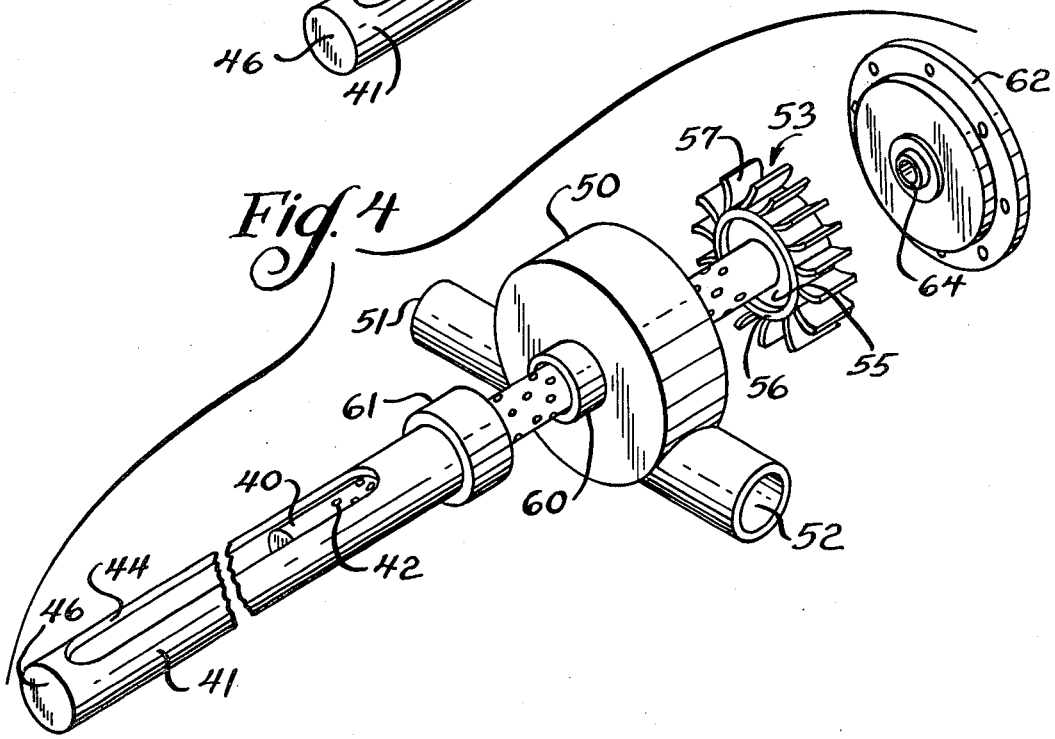
FIG. 4 is an exploded perspective view of the spraying apparatus of FIG. 3 further illustrating the construction of the spraying apparatus and better illustrating the internal construction of the turbine portion of the apparatus.
Figure 5:
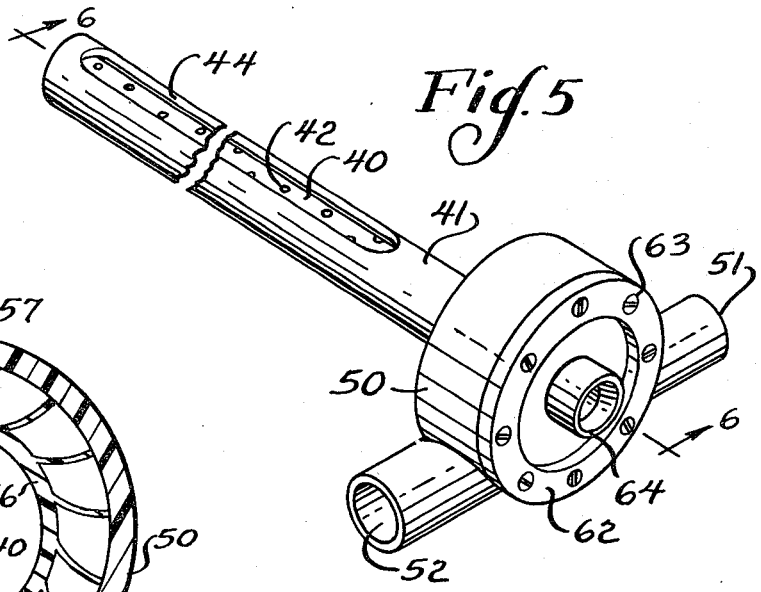
FIG. 5 is a perspective view of the spraying apparatus taken from an opposite angle to that in FIG. 3.
Figure 7:
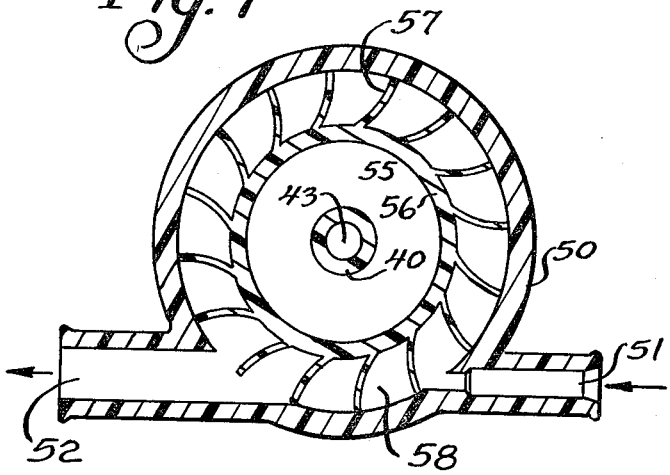
FIG. 7 is a sectional view of the turbine portion of the spraying apparatus taken substantially along line 7—7 in FIG. 6.

Referring generally to FIGS. 1 and 2, there is shown an ice making machine, generally designated 10, of the residential or office type designed to be of a height suitable for installation under kitchen cabinets or the like and of sufficiently narrow width to alternatively fit conveniently into a closet or other desired installation location. It will be more completely hereinafter appreciated that the spraying apparatus of the present invention also has utility in other types of ice cube making machines, such as the considerably larger commercial type units. The general operation of such ice cube making machines is well known to the prior art. A compressor 11 compresses a refrigerant fluid which is cooled by finned condenser coils 12 after which the cooled and compressed refrigerant fluid flow to evaporator coils 13. Prior to the refrigerant fluid entering the evaporator coils, the pressure of the refrigerant fluid is released into the larger diameter evaporator coils which are thereby cooled to a temperature well below the freezing point of water. The finned condenser coils may be either air or water cooled with air cooling preferred for most applications because of lower manufacturing cost.

A plurality of ice forming cups 14 are thermally connected to evaporator coils 13 as by direct soldering thereto or by other metallic contact for efficiently cooling of ice forming cups 14. Water is circulated in the ice cube making machine by a pump 15 which is typically driven by an electric motor 16 which, in turn, is controlled by a timer 17 which controls the ice cube making cycle.

Figure 10:
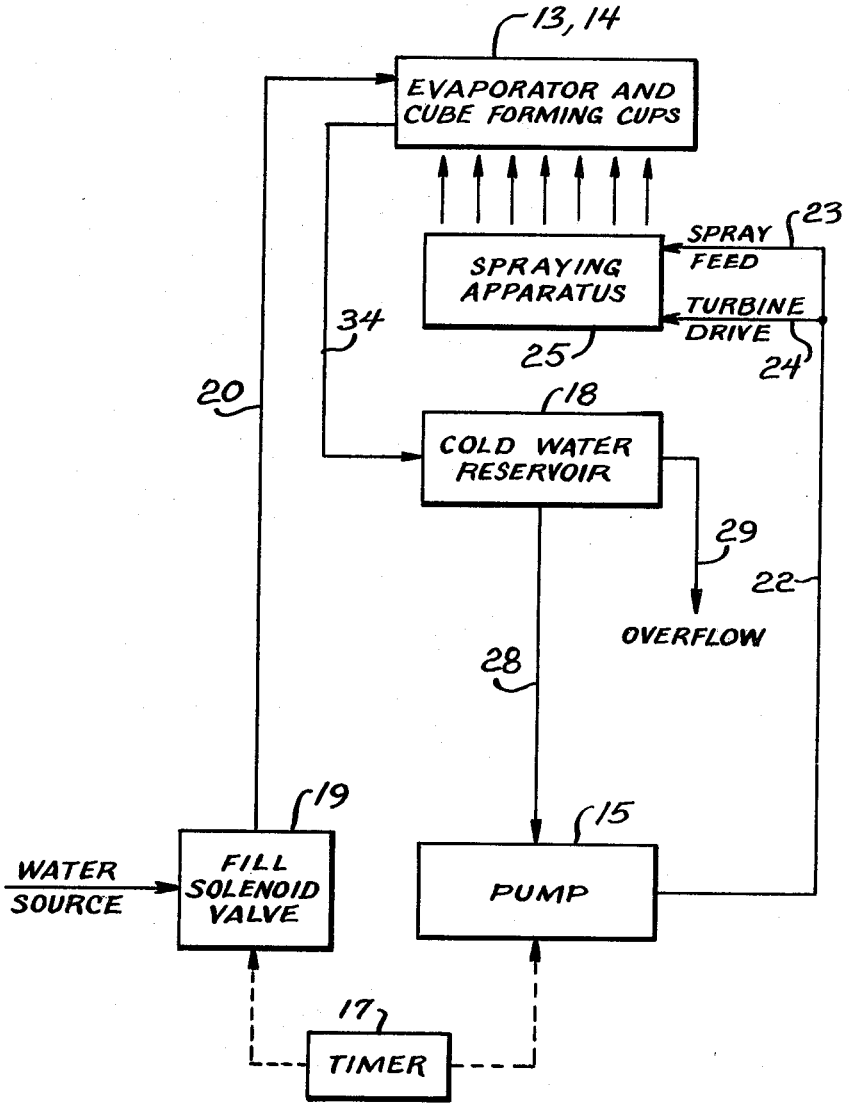
FIG. 10 is a water flow diagram in schematic form illustrating the flow of water throughout the ice making machine, including the spraying apparatus.

The water circulation cycle can best be understood with additional reference to FIG. 10. A water resorvoir 18 in ice cube making machine 10 is indirectly filled with water from a water source, such as a tap or water faucet (not shown). Timer 17 causes energization of a water fill solenoid valve 19 to supply water through a conduit 20 about evaporator coils 13 which then drains into water reservoir 18 as by a conduit 34 therebetween. Pump 15 begins pumping water from reservoir 18 via conduit 34 through respective water conduits 22, 23 and 24 to spraying apparatus 25 of the present invention. As more fully presented hereinafter, water is sprayed by spraying apparatus 25 and any unfrozen water returns to water reservoir 18. The water fill solenoid valve 19 remains open for a predetermined time as determined by timer 17. Thereafter, pump 15 continuously circulates water from the cold water resorvoir 18 via water conduit 28 disposed in the bottom of reservoir 18 and through conduits 22, 23 and 24 to spraying apparatus 25. This closed pumping or circulation system keeps the water cold at about the freezing point.

An overflow conduit 29 in fluid communication with reservoir 18 limits the amount of water in the reservoir to a predetermined volume sufficient for one ice cube forming cycle of machine 10. That is, the volume of water contained within reservoir 18 is generally designed to accommodate a sufficient volume of water for one ice cube forming cycle of machine 10 with a minimum of excess water such that additional volumes of water are not needlessly cooled by the machine or expelled after the ice cube forming cycle is completed.

The water in reservoir 18 is gradually cooled by contact with the sub-freezing temperature ice forming cups 14 or with the ice formed therein such that the water temperature will quickly near the freezing temperature of 32° F., or may actually be slightly below the freezing point due to the presence of minerals, salts or the like in solution in the water. As machine 10 continues to operate, layers of ice are formed in ice cube forming cups 14. When formation of the crystal clear ice cubes is complete, as determined by timer 17, or by other temperature sensing apparatus (not shown), the timer stops circulation of water from reservoir 18 through conduits 28, 21, 22 and 23 to spraying apparatus 25.

Removal of the formed ice cubes from the forming cups 14 then begins. Timer 17 again energizes water fill solenoid valve 19 such that water from the warmer temperature water source flows through conduit 20 about the top side of cube forming cups 14 to melt the contact of the formed ice cubes with cups 14. When this contact of the formed cubes with cups 14 is sufficiently melted, the formed cubes fall under the influence of gravity from the forming cups 14 and slide down an inclined wire grill 30 past hinged flaps 31 into an ice cube accumulation and storage area 32. During the ice cube discharge or removal cycle, the warmer water continuously overflows from the evaporator side of cube forming cups 14 into reservoir 18 by means of overflow apertures or conduit 34 and thence through overflow conduit 29 to an appropriate drain or sewer (not shown). Timer 17 provides sufficient time for the discharge cycle to permit all ice cubes to be discharged from the cube forming cups 14. The ice cube forming cycle may then be reinitiated depending upon the quantity or volume of ice cubes in storage bin 32.

Ice cube storage and accumulation bin 32 is typically insulated by an insulating material 36 surrounding bin 32. A hinged door 37 permits access to bin 32 for removal of the formed ice cubes. Bin 32 also has a drain via a discharge conduit 38 to drain any water from ice cube bin 32 due to melting of cubes or the like.

The foregoing description of a typical ice cube making machine 10 has been presented for a better understanding of the operation and environment of the spraying apparatus 25 of the present invention. It will be understood that this description is merely exemplary and that the spraying apparatus of the present invention may be used with differing types of ice cube making machines and is, therefore, not to be limited to the aforedescribed machine 10.

Illustrated in FIGS. 3 through 8 is the preferred embodiment of the spraying apparatus 25 of the present invention. In accordance with one aspect of the present invention, spraying means in the form of a hollow tube 40 is coaxially disposed in shielding means in the form of another tube 41. Tube 41 has an inside diameter slightly greater than the outside diameter of tube 40 to provide sufficient operational clearances therebetween such that tube 40 may be freely rotated within tube 41. Hollow tube 40 has a plurality of apertures or orifices 42 defined therethrough such that water from an interior area 43 of tube 40 may be sprayed through orifices 42. The operational clearances are preferably limited to no more than about several thousandths of an inch such that rotation of spraying tube 40 within shielding tube 41 provides a self-cleaning action to remove sediment or mineral deposit buildups about orifices 42 since any initial buildups of sediment or mineral deposits will result in rubbing of such deposits against shielding tube 41. In this regard, shielding tube 41 is provided with at least one cut out or slot 44 such that water may be sprayed from those orifices 42 which are not shielded by shielding tube 41. One end 45 of tube 40 is closed and one end 46 of shielding tube 46 is similarly closed. However, it will be appreciated that ends 45 and 46 of respective tubes 40 and 41 need not both be closed as the closing of only one of these ends is generally needed to direct the water through orifices 42.

Cut out or slot 44 in shielding tube 41 may be a single slot elongated in the direction of the axis of tube 41, or may alternatively be subdivided into a plurality of slots or apertures. The angular width of slot 44 determines the angular arc $\alpha$ (FIGS. 2 and 8) of the spray which is discharged from orifices 42 in spraying tube 40 toward the ice forming surfaces in ice forming cups 14. The angular width of slot 44 is dependent upon the spacing between shielding tube 41 and the ice forming surface and the size or width of the ice forming surface. This angular arc $\alpha$ of slot 44 may, by way of example, be about 45°, but as mentioned above may vary considerably depending upon the interior geometry of the ice cube making machine. For example, angle $\alpha$ may vary from about 10° to 90° or more. Cut out or slot 44 extends axially in tube 41 for approximately the same length in which apertures 42 are defined in spraying tube 40. Ordinarily the axial length of slot 44 will be approximately equal to the length of the ice forming surface since the spray of water from orifices 42 will be in a generally radial direction to spraying tube 40. Spraying tube 40 must, therefore, be of sufficient length to accommodate the entire length of the ice forming surface in ice making machine 10. For example, spraying tube 40 may have orifices 42 defined therein for approximately a twelve inch axial length of tube 40 and slot 44 in shielding tube 41 will be of corresponding length in a residential type ice making machine 10. The length of spraying tube 40 and slot 44 in shielding tube 41 may be either shorter or longer depending upon the design of the ice forming surface in the particular machine of interest.

Generally spraying tube 40 will fit within shielding tube 41 with relatively close tolerances such that those apertures 42 which are shielded by shielding tube 41 will experience a minimum of fluid leakage between tubes 40 and 41. While there will be some fluid leakage between these tubes, it will, of course, be recognized that the amount of leakage is dependent upon the operational clearance between tubes 40 and 41 and the number and size of apertures 42. The total sum of all of the cross-sectional areas of the orifices 42 will generally be less than the cross-sectional area of the interior of spraying tube 40 such that there will not be substantial fluid pressure differences or differentials in the hollow interior area 43 at different axial positions along tube 40. Apertures 42 will, therefore, generally be of less than 0.100 inches in diameter and will more typically be in the range of about 0.010 to 0.050 inches in diameter. To provide a good dispersion of fluid sprayed from spraying tube 40, apertures 42 are preferably disposed at various axial positions, rather than having a plurality of apertures 42 at a common axial point. In this respect, it is further understood that apertures 42 are preferably positioned at axial points which do not coincide with the wires of inclined grill 30 which are typically parallel and spaced apart on approximately one-half inch centers. That is, apertures 42 are positioned in spraying tube 40 to spray onto the ice forming surface of machine 10 between the wires of inclined grill 30.

In accordance with another aspect of the present invention, the spraying apparatus 25 is further provided with means for rotating spraying tube 40 such that fluids sprayed therefrom continuously sweep across the ice forming surface of machine 10. All portions of the ice forming surface are continually being sprayed and an improved dispersion of fine streams of water onto the ice forming surface is also obtained. The preferred rotational means includes a turbine housing 50 having a water inlet 51 and a water outlet 52 with a turbine blade assembly 53 rotationally disposed in housing 50. Turbine blade assembly 53 is directly connected about an open end 54 of spraying tube 40 by a web 55 radially extending between an outer surface of spraying tube 40 to a hub or drum 56 of turbine blade assembly 53. Hub 56 has a plurality of turbine blades 57 secured thereto and projecting therefrom at spaced circumferential positions. A known and predetermined volume 58 is defined between adjacent turbine blades 57, hub 56, and turbine housing 50. This type of turbine structure is generally known to the turbine art as a Pelton turbine.

Pressurized water through inlet 51 successively fills these predetermined volumes 58 to cause rotation of turbine blade assembly 53 within turbine housing 50. Water is discharged from larger diameter outlet 52 under substantially no pressure, i.e. gravity flow, back into the cold water reservoir 18. As turbine blade assembly 53 rotates, spraying tube 40 similarly rotates. The rotational velocity may typically be in the range of 100 to 1,000 revolutions per minute and, under such rotational velocity, water in spraying tube 40 is discharged through orifices 42 under both the pressure in interior area 43 of tube 40 as well as due to centrifugal forces caused by rotation of spraying tube 40 within shielding tube 41. Water pressure in interior area 43 may be quite low, for example about 2 PSI, and good spraying action is still maintained due to the angular velocities imparted to the water stream by the rotating spraying tube 40. This angular velocity imparted to the water stream enhances the formation of tiny water droplets sprayed onto the ice forming surface in machine 10 as well as enhancing droplet formation caused by the water streams striking the ice forming surface under increased velocity. A single ice cube forming cycle may take only 12 to 15 minutes instead of the 25 to 30 minutes required when prior art spraying apparatus is employed.

Turbine housing 50 is provided with a projecting neck or collar 60 which is coaxial with spraying tube 40 and of approximately the same internal diameter as shielding tube 41. Shielding tube 41 has an enlarged collar 61 for frictionally fitting onto neck 60 of turbine housing 50. The angular position of slot 44 in shielding tube 41 may, therefore, be adjusted by rotating shielding tube 41 relative to turbine housing 50 to the desired spraying position. Alternatively, neck 60 of turbine 50 could be of larger diameter than the open end of shielding tube 41 such that shielding tube 41 would fit directly into neck 60. In another embodiment, some cylindrical clamping means (not shown) could be disposed about enlarged collar 61 to aid in securing shielding tube 41 relative to turbine housing 50.

Figure 6:
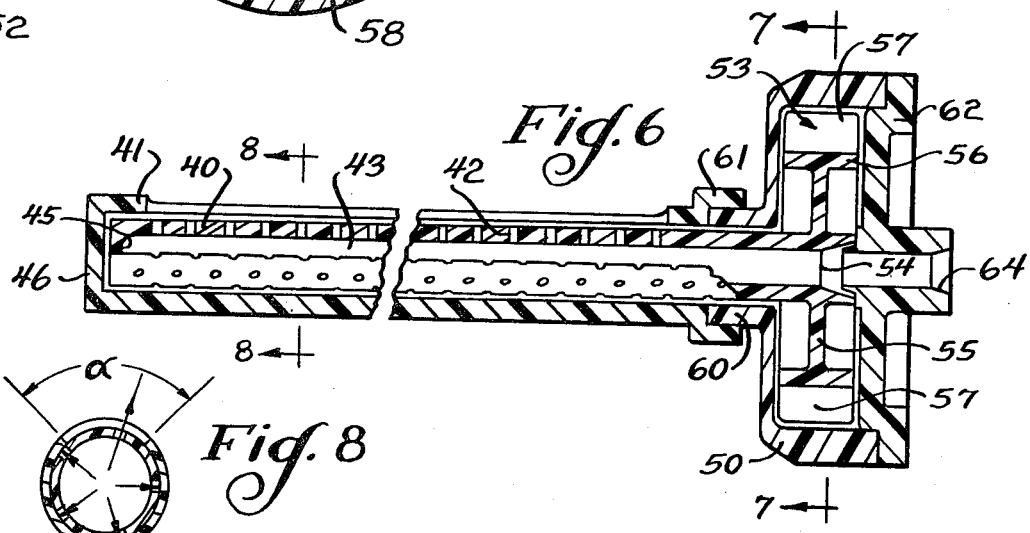
FIG. 6 is a sectional view of the spraying apparatus taken substantially along line 6—6 in FIG. 5 further illustrating the internal construction of the spraying apparatus.
Figure 8:
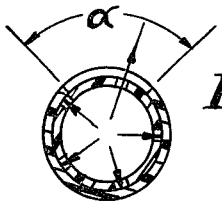
FIG. 8 is a sectional view of the spraying portion of the spraying apparatus taken substantially along line 8—8 in FIG. 6.

A cover 62 encloses the turbine blade assembly 53 within turbine housing 50 and may be fastened thereto as by threaded fasteners 63. A sealing gasket (not shown) may be used between cover 62 and turbine housing 50 although this may not often be necessary since an inappreciable amount of fluid leakage will not interfere with operation of the turbine and any leakage merely returns to water reservoir 18 to be recirculated in the fluid system of ice making machine 10. Cover 62 is provided with a short conduit 64 extending therethrough at a generally central location since that conduit 64 is in generally coaxial relationship with spraying tube 40 when cover 62 is installed onto turbine housing 50. Spraying tube 40 derives fluid from fluid supply conduit 23 (FIG. 10) through conduit 64 in cover 62 into interior area 43 of spraying tube 40. As is best seen in FIG. 6, conduit 64 preferably projects slightly into open end 54 of spraying tube 40 to provide a self-aligning bearing for turbine blade assembly 53 and spraying tube 40 within turbine housing 50.

As can be readily appreciated from the foregoing description of spraying apparatus 25, the spraying apparatus will be economical to manufacture since only four separate components are required, namely spraying tube 40 with the integral turbine blade assembly 53, shielding tube 41, rotor housing 50 and cover 62. Each of these four components may be easily fabricated. Thermoplastic materials are preferred because of the self-lubricating qualities of such material between moving components. The spraying apparatus 25 may also be readily formed from thermosetting plastics or from various metals which are not subject to corrosion in the high humidity environment of the spraying apparatus.

Figure 9:
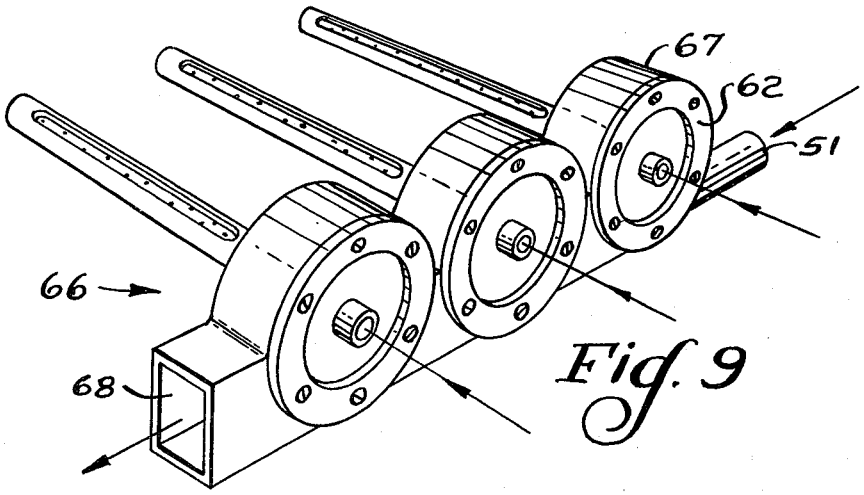
FIG. 9 is a perspective view of a multiple spraying unit having a unitary turbine housing, but with each of the multiple spraying units otherwise similar in operation and construction to the single unit spraying apparatus illustrated in FIGS. 3-8.

Shown in FIG. 9 is a multiple spraying unit, generally designated 66. This multiple spraying unit has a similar spraying tube 40, shielding tube 41 and cover 62 for each of the three individual spraying units. A different turbine housing 67 is employed such that pressurized water through inlet 51 moves progressively through each of the three turbines and then is released through an outlet 68. Multiple spraying apparatus 66 operates in a manner similar to spraying apparatus 25, but is capable of more effectively and uniformly spraying larger ice forming surfaces than spraying apparatus 25.

While particular embodiments of the invention have been shown and described, it will be obvious to those skilled in the art that changes and modifications may be made without departing from the invention in its broader aspects and, therefore, the aim of the appended claims is to cover all such changes and modifications as fall within the true spirit and scope of the invention.

I claim:

1. A spraying unit for spraying fluid in a predetermined angular arc from the spraying unit onto a surface in spaced relation from the spraying unit, said spraying unit comprising:

rotatable spraying means with a plurality of orifices extending into a hollow interior of the spraying means, the hollow interior of the spraying means adapted to communicate with a supply of fluid to be sprayed;

shielding means disposed about said rotatable spraying means with sufficient operational clearance between said spraying means and said shielding means to permit said spraying means to be rotated within said shielding means while said shielding means remains relatively stationary with respect thereto, said shielding means having at least one open area through which fluid may be sprayed through those orifices of the spraying means which are encompassed by the open area in said shielding means, said shielding means being adjustably disposed with respect to said spraying means for selectively regulating the direction of spraying; and means for rotating said spraying means whereby fluid is directionally sprayed from said spraying means through the open area in said shielding means in a plurality of fine streams which continuously sway across the surface being sprayed.

2. The spraying unit as defined in claim 1 wherein said rotatable spraying means comprises an elongate and hollow cylindrical tube with a plurality of apertures defined therethrough, the cylindrical tube being closed at one end and open at an opposite end for communicating with said supply of fluid.

3. A spraying unit as defined in claim 2 wherein said means for rotating said spraying unit comprises a turbine operatively connected to said cylindrical spraying tube, said turbine hydraulically driven by said supply of fluid to cause rotation of said spraying tube.

4. The spraying unit as defined in claim 3 wherein said turbine blade assembly forms an integral part of one end of said cylindrical spraying tube.

5. The spraying head as defined in claim 1 wherein said shielding means comprises a cylindrical tube of slightly larger inside diameter than the outside diameter of said cylindrical spraying tube, said cylindrical shielding tube being closed at the same end as said cylindrical spraying tube.

6. The spraying unit as defined in claim 5 wherein the open area in said shielding means defines an elongate slot extending substantially the entire axial length of said shielding tube.

7. A spraying unit for spraying water in a predetermined angular arc from the spraying unit onto a surface in spaced relation from the spraying unit, said spraying unit comprising:

cylindrical spraying means having a hollow interior, one end of the cylindrical spraying means being closed and an opposite end of the cylindrical spraying means being open to communicate with a supply of fluid to be sprayed;

a plurality of orifices defined in said cylindrical spraying means through which the fluid in a hollow interior area of the cylindrical spraying means may be sprayed;

a turbine housing having a water inlet and a water outlet;

turbine blade means disposed in said turbine housing and adapted to be rotationally driven by fluid pressure at said fluid inlet, said turbine blade means operatively connected to said cylindrical spraying means to rotate said cylindrical spraying means; and shielding means disposed about said cylindrical spraying means with sufficient operational clearance there-between to permit said spraying means to be rotated within the shielding means, said shielding means having at least one open area defined therethrough to permit fluid to be sprayed in a plurality of fine streams through those orifices of the spraying means which are encompassed by the open area in the shielding means; the open area in the shielding means thereby determining the angular arc through which spraying is effected, said shielding means being adjustably secured to said turbine housing such that the direction of spraying may be adjusted.

* * * * *